US006090169A

United States Patent [19]

Krull et al.

[11] Patent Number: 6,090,169

[45] **Date of Patent: *Jul. 18, 2000**

[54] PROCESS FOR IMPROVING THE COLD-FLOW PROPERTIES OF FUEL OILS

[75] Inventors: Matthias Krull, Oberhausen; Werner Reimann, Frankfurt, both of Germany

[73] Assignee: Clariant GmbH, Frankfurt, Germany

[ * ] Notice: This patent is subject to a terminal disclaimer.

[21] Appl. No.: 09/235,724

[22] Filed: Jan. 22, 1999

[30] Foreign Application Priority Data

Jan. 24, 1998 [DE] Germany ..... 198 02 689

[51] Int. Cl.[7] ..... C10L 1/18

[52] U.S. Cl. ..... 44/395

[58] Field of Search ..... 44/393, 395

[56] References Cited

U.S. PATENT DOCUMENTS

| | | | |
|---|---|---|---|
| 3,048,479 | 8/1962 | Ilnyckyj et al. | 44/393 |
| 3,961,916 | 6/1976 | Ilnyckyj et al. | 44/395 |
| 3,981,850 | 9/1976 | Wisotsky et al. | 526/227 |
| 4,087,255 | 5/1978 | Wisotsky et al. | 44/393 |
| 4,211,534 | 7/1980 | Feldman | 44/394 |
| 4,670,516 | 6/1987 | Sackmann et al. | 525/327.6 |
| 4,713,088 | 12/1987 | Tack et al. | 44/397 |
| 4,746,327 | 5/1988 | Smyser | 44/393 |
| 4,985,048 | 1/1991 | Wirtz et al. | 44/394 |
| 5,045,088 | 9/1991 | More et al. | 44/393 |
| 5,186,720 | 2/1993 | Feustel et al. | 44/351 |
| 5,391,632 | 2/1995 | Krull et al. | 525/327.6 |
| 5,767,190 | 6/1998 | Krull et al. | 524/563 |

FOREIGN PATENT DOCUMENTS

| | | |
|---|---|---|
| 0153176 | 8/1985 | European Pat. Off. . |
| 0154177 | 9/1985 | European Pat. Off. . |
| 0271738 | 6/1988 | European Pat. Off. . |
| 0320766 | 6/1989 | European Pat. Off. . |
| 0413279 | 2/1991 | European Pat. Off. . |
| 0606055 | 7/1994 | European Pat. Off. . |
| 0922716 | 6/1999 | European Pat. Off. . |
| 11467799 | 11/1963 | Germany . |
| 2206719 | 10/1972 | Germany . |
| 1914756 | 11/1996 | Germany . |
| 19620118 | 10/1997 | Germany . |
| 197 29 056 | 12/1998 | Germany . |
| WO 96/17905 | 6/1996 | WIPO . |

OTHER PUBLICATIONS

EPO Search Report—Aug. 1999.

Derwent Patent Family Report and/or Abstracts Jun. 16, 1999 and Dec. 3, 1998.

"Comb–Like Polymers, Structure and Properties," N.A. Platé and V.P. Shibaev, J. Poly. Sci. Macromolecular Revs, vol. 8, 1974, 117ff.

Derwent Abstract EP 796306 Jun. 13, 1996.

*Primary Examiner*—Jacqueline V. Howard
*Assistant Examiner*—Cephia D. Toomer
*Attorney, Agent, or Firm*—Miles D. Dearth; Scott E. Hanf

[57] ABSTRACT

The invention relates to a process for improving the cold-flow properties of oils having a sulfur content of less than 500 ppm and a content of n-paraffins having a chain length of $C_{18}$ or longer of at least 8% by weight, comprising adding an additive comprising a mixture of A) from 15 to 50% by weight of a copolymer comprising, besides from 87 to 92 mol % of structural units derived from ethylene;

a) from 6.5 to 12 mol % of structural units derived from vinyl acetate and b) from 0.5 to 6 mol % of structural units derived from 4-methyl-1-pentene, with the proviso that the sum of the molar proportions of structural units a) and b) is from 8 to 14 mol %, and B) from 85 to 50% by weight of at least one further copolymer or terpolymer of ethylene and vinyl esters or acrylates which is per se a cold-flow improver.

The invention furthermore relates to an additive for improving the cold-flow behavior of mineral oils and mineral-oil distillates, and to fuel oil compositions containing these additives.

10 Claims, No Drawings

PROCESS FOR IMPROVING THE COLD-FLOW PROPERTIES OF FUEL OILS

FIELD OF THE INVENTION

The present invention relates to a process for improving the cold-flow properties of mineral oils and mineral-oil distillates while retaining the filterability of the oils, to an additive mixture, and to oils containing the additives.

DESCRIPTION OF THE RELATED ART

Crude oils and middle distillates obtained by distillation of crude oils, such as gas oil, diesel oil or heating oil, contain, depending on the origin of the crude oils, various amounts of n-paraffins, which, when the temperature is reduced, crystallize out as platelet-shaped crystals and in some cases agglomerate with inclusion of oil. This causes an impairment of the flow properties of these oils or distillates, which can result in problems during the recovery, transport, storage and/or use of the mineral oils and mineral-oil distallates. In the case of mineral oils, this crystallization phenomenon can cause deposits on the walls of transportation pipelines, especially in winter, and in individual cases, for example during stoppage in a pipeline, can even cause complete blocking thereof. Precipitation of paraffins can also cause problems during storage and further processing of the mineral oils. In winter, for example, it may in some circumstances be necessary to store the mineral oils in heated tanks. In the case of mineral-oil distallates, the crystallization can result in blockage of the filters in diesel engines and furnaces, preventing reliable metering of the fuels and in some cases causing complete interruption of the supply of fuel or heating medium.

In addition to the classical methods of eliminating the crystallized paraffins (thermal, mechanical or using solvents), which merely involve the removal of the precipitates which have already formed, recent years have seen the development of chemical additives (so-called flow improvers or paraffin inhibitors), which, by interacting physically with the precipitating paraffin crystals, result in their shape, size and adhesion properties being modified. The additives act as additional crystal nuclei and partly crystallize with the paraffins, resulting in an increased number of relatively small paraffin crystals having a modified crystal shape. The action of the additives is also partly explained by dispersal of the paraffin crystals. The modified paraffin crystals have a lower tendency toward agglomeration, so that the oils to which these additives have been added can still be pumped and/or processed at temperatures which are frequently more than 20° lower than in the case of oils containing no additives.

The flow and low-temperature behavior of mineral oils and mineral-oil distallates is described by indicating the cloud point (determined in accordance with ISO 3015), the pour point (determined in accordance with ISO 3016) and the cold filter plugging point (CFPP, determined in accordance with EN 116). All these parameters are measured in ° C.

Typical flow improvers for crude oils and middle distillates are copolymers of ethylene with carboxylates of vinyl alcohol. Thus, DE-A-11 4 799 proposes adding oil-soluble copolymers of ethylene and vinyl acetate having a molecular weight of between about 1000 and 3000 to petroleum distillate fuels having a boiling point of between about 120 and 400° C. Preference is given to copolymers comprising from about 60 to 99% by weight of ethylene and from about 1 to 40% by weight of vinyl acetate. They are particularly effective when prepared by free-radical polymerization in an inert solvent at temperatures of from about 70 to 130° C. and pressures of from 35 to 2100 bar above atmospheric pressure (DE-A-19 14 756). The prior art also describes mixtures of copolymers as flow improvers.

DE-A-22 06 719 discloses mixtures of ethylene-vinyl acetate copolymers having various comonomer contents for improving the low-temperature flow behavior of middle distillates.

U.S. Pat. No. 3,961,916 discloses mixtures of various vinyl esters or acrylates with one another or with each other as cold-flow improvers for middle distillates.

DE-A-196 20 118 discloses terpolymers of ethylene, vinyl acetate and 4-methyl-1-pentene as cold-flow improvers for middle distillates.

EP-A-0 706 306 discloses additives for stabilizing the CFPP in middle distillates. These additives comprise mixtures of copolymers and terpolymers of ethylene and vinyl esters. A disadvantage of the mixtures proposed therein is the proportion of highly crystalline polymer constituents, which, in particular at low oil and/or additive temperatures, impair the filterability of the oils to which they have been added.

In particular in middle distillates having a narrow distillation range at the same time as a high boiling limit, conventional flow improvers cause problems. It is observed that the CFPP established in these oils by such flow improvers is not stable, but drops over the course of a few days to weeks to the CFPP of oils containing no additive (CFPP reversion). The cause of this is unknown, but is assumed to be incomplete redissolution of the polymer constituents of low comonomer content from the oil which has already become cloudy. Prevention of CFPP reversion is a particular problem in oils having a low sulfur content, since, owing to the desulfurization steps, these oils have a particularly high content of long-chain n-paraffins with chain lengths of greater than $C_{18}$.

The object was therefore to find additives for said mineral oils and mineral-oil distallates which result in very good CFPP lowering and in which no CFPP reversion occurs and which do not impair the filterability at above the cloud point of the oils containing additives.

SUMMARY OF THE INVENTION

Surprisingly, it has been found that this object can be achieved by mixtures which comprise a copolymer of vinyl acetate, ethylene and 4-methyl-1-pentene and a copolymer of ethylene and vinyl esters or acrylates.

The invention relates to a process for improving the cold-flow properties of oils having a sulfur content of less than 500 ppm and a content of n-paraffins having a chain length of $C_{18}$ or longer of at least 8% by weight, comprising adding an additive comprising a mixture of A) from 15 to 50% by weight of a copolymer comprising, besides from 87 to 92 mol % of structural units derived from ethylene;
   a) from 6.5 to 11 mol % of structural units derived from vinyl acetate and
   b) from 0.5 to 5 mol % of structural units derived from 4-methyl-1-pentene, with the proviso that the sum of the molar proportions of structural units a) and b) is from 8 to 13 mol %, and B) from 85 to 50% by weight of at least one further copolymer or terpolymer of ethylene and vinyl esters or acrylates which is per se a cold-flow improver.

The data in % by weight relates to the total weight of the mixture of A) and B).

The invention furthermore relates to an additive for improving the cold-flow behavior of mineral oils and mineral-oil distillates, and to fuel oil compositions containing these additives.

The mixture of copolymers preferably comprises from 20 to 40% by weight of component A) and from 60 to 80% by weight of component B).

DESCRIPTION OF THE PREFERRED EMBODIMENTS

Component A) is preferably a terpolymer containing from 7 to 11 mol % of structural units derived from vinyl acetate. Component A) furthermore preferably contains from 1 to 4 mol % of structural units derived from 4-methyl-1-pentene. The total comonomer content, i.e. the content of structural units a) and b), is, in a preferred embodiment, between 10 and 13 mol %. In a further preferred embodiment, component A) contains from 5 to 9 methyl groups per 100 methylene groups, with the exclusion of methyl groups derived from vinyl acetate. The number of methyl groups is determined by $^1$H-NMR spectroscopy.

Copolymer B) is preferably an ethylene copolymer having a comonomer content of from 10 to 20 mol %, preferably from 12 to 18 mol %. Suitable comonomers are vinyl esters of aliphatic carboxylic acids having 2 to 15 carbon atoms. Preferred vinyl esters for copolymer B) are vinyl acetate, vinyl propionate, vinyl hexanoate, vinyl laurate and vinyl esters of neocarboxylic acids, here in particular of neononanoic, neodecanoic and neoundecanoic acid. Particular preference is given to an ethylene-vinyl acetate copolymer, an ethylene-vinyl propionate copolymer, an ethylene-vinyl acetate-vinyl neononanoate copolymer or an ethylene-vinyl acetate-vinyl neodecanoate terpolymer. Further suitable comonomers are olefins, such as propene, hexene, butene, isobutene, diisobutylene, 4-methyl-1-pentene and norbornene. Particular preference is given to ethylene-vinyl acetate-diisobutylene and ethylene-vinyl acetate-4-methyl-1-pentene terpolymers.

The copolymers used for the additive mixtures can be prepared by conventional copolymerization processes, for example suspension polymerization, solution polymerization, gas-phase polymerization or high-pressure bulk polymerization. Preference is given to high-pressure bulk polymerization, preferably at pressures of from 50 to 400 MPa, in particular from 100 to 300 MPa, and preferably at temperatures of from 50 to 350° C., in particular from 100 to 250° C. The reaction of the monomers is initiated by initiators which form free radicals (free-radical chain initiators). This class of substances includes, for example, oxygen, hydroperoxides, peroxides and azo compounds, such as cumene hydroperoxide, t-butyl hydroperoxide, dilauroyl peroxide, dibenzoyl peroxide, bis(2-ethylhexyl) peroxide carbonate, t-butyl perpivalate, t-butyl permaleate, t-butyl perbenzoate, dicumyl peroxide, t-butyl cumyl peroxide, di(t-butyl) peroxide, 2,2'-azobis(2-methylpropionitrile) and 2,2'-azobis(2-methylbutyronitrile). The initiators are employed individually or as a mixture of two or more substances in amounts of from 0.01 to 20% by weight, preferably 0.05 to 10% by weight, based on the monomer mixture.

The additive components preferably have melt viscosities at 140° C. of from 20 to 10,000 mPas, in particular from 30 to 5000 mPas, especially from 50 to 2000 mPas. The melt viscosities of A and B may be identical or different. A is preferably >B. The desired melt viscosity of the mixtures is established through the choice of the individual components and by varying the mixing ratio of the copolymers.

The copolymers mentioned under A) and B) can contain up to 5% by weight of further comonomers. Examples of such comonomers are vinyl esters, vinyl ethers, alkyl acrylates, alkyl methacrylates having $C_1$- to $C_{20}$-alkyl radicals, isobutylene or higher olefins having at least 5 carbon atoms. Preferred higher olefins are hexene, isobutylene, octene and/or diisobutylene.

The high-pressure bulk polymerization is carried out batchwise or continuously in known high-pressure reactors, for example autoclaves or tubular reactors, the latter having proved particularly successful. Solvents, such as aliphatic and/or aromatic hydrocarbons or hydrocarbon mixtures, benzene or toluene, may be present in the reaction mixture. The polymerization is preferably carried out in the absence of a solvent. In a preferred embodiment of the polymerization, the mixture of the monomers, the initiator and, if used, the moderator is fed to a tubular reactor via the reactor inlet and via one or more side branches. The monomer streams here can have different compositions (EP-A-0 271 738).

The additive mixtures are added to mineral oils or mineral-oil distillates in the form of solutions or dispersions. These solutions or dispersions preferably comprise from 1 to 90% by weight, in particular from 5 to 80% by weight, of the mixtures. Suitable solvents or dispersion media are aliphatic and/or aromatic hydrocarbons or hydrocarbon mixtures, for example gasoline fractions, kerosine, decane, pentadecane, toluene, xylene, ethylbenzene or commercial solvent mixtures, such as solvent naphtha, ®Shellsoll AB, ®Solvesso 150, ®Solvesso 200, ®Exxsol, ®ISOPAR and ®Shellsol D products. The solvent mixtures mentioned contain various amounts of aliphatic and/or aromatic hydrocarbons. The aliphatics can be straight-chain (n-paraffins) or branched (iso-paraffins). Aromatic hydrocarbons can be monocyclic, bicyclic, or polycyclic and may carry one or more substituents. Mineral oils or mineral-oil distallates whose rheological properties have been improved by the additive mixtures contain from 0.001 to 2% by weight, preferably from 0.005 to 0.5% by weight, of the mixtures, based on the distillate.

In order to prepare additive packages for certain problem solutions, the mixtures can also be employed together with one or more oil-soluble coadditives which even alone improve the cold-flow properties of crude oils, lubricating oils or fuel oils. Examples of such coadditives are polar compounds which effect paraffin dispersal (paraffin dispersants) and comb polymers.

Paraffin dispersants reduce the size of the paraffin crystals and have the effect that the paraffin particles do not deposit, but instead remain colloidally dispersed with a significantly reduced tendency to sediment. Paraffin dispersants which have proven successful are oil-soluble polar compounds containing ionic or polar groups, for example amine salts and/or amides, which are obtained by reacting aliphatic or aromatic amines, preferably long-chain aliphatic amines, with aliphatic or aromatic mono-, di-, tri- or tetracarboxylic acids or anhydrides thereof (U.S. Pat. No. 4,211,534). Other paraffin dispersants are copolymers of maleic anhydride and α,β-unsaturated compounds, which can, if desired, be reacted with primary monoalkylamines and/or aliphatic alcohols (EP-A-0 154 177), the products of the reaction of alkenylspirobislactones and amines (EP-A-0 413 279) and, as described in EP-A-0 606 055, products of the reaction of terpolymers based on α,β-unsaturated dicarboxylic anhydrides, α,β-unsaturated compounds and polyoxyalkenyl ethers of lower unsaturated alcohols. Alkylphenol-formaldehyde resins are also suitable as paraffin dispersants.

The term comb polymers is taken to mean polymers in which hydrocarbon radicals having at least 8, in particular at least 10, carbon atoms are bonded to a polymer backbone. Preference is given to homopolymers whose alkyl side chains contain at least 8 and in particular at least 10 carbon atoms. In the case of copolymers, at least 20%, preferably at least 30%, of the monomers have side chains (cf. Comb-like Polymers—Structure and Properties; N. A. Platé and V. P. Shibaev, J. Polym. Sci. Macromolecular Revs. 1974, 8, 117 ff). Examples of suitable comb polymers are fumarate-vinyl acetate copolymers (cf. EP-A-0 153 176), copolymers of a $C_6$-$C_{24}$-α-olefin and an N-$C_6$- to $C_{22}$-alkylmaleimide (cf. EP-A-0 320 766), furthermore esterified olefin-maleic anhydride copolymers, polymers and copolymers of α-olefins and esterified copolymers of styrene and maleic anhydride.

For example, comb polymers can be described by the formula

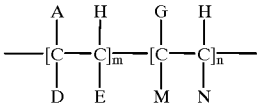

in which

A is R', COOR', OCOR', R"-COOR' or OR';

D is H, $CH_3$, A or R";

E is H or A;

G is H, R", R"-COOR', an aryl radical or a heterocyclic radical;

M is H, COOR", OCOR", OR" or COOH;

N is H, R", COOR", OCOR or an aryl radical;

R' is a hydrocarbon chain having 8 to 50 carbon atoms;

R" is a hydrocarbon chain having 1 to 10 carbon atoms;

m is a number between 0.4 and 1.0; and n is a number between 0 and 0.6.

The mixing ratio (in parts by weight) of the additive mixtures with paraffin dispersants and/or comb polymers is in each case from 1:10 to 20:1, preferably from 1:1 to 10:1.

Particularly suitable fuel components are middle distillates. The term middle distillates is taken to mean, in particular, mineral oils which have been obtained by distillation of crude oil and boil in the range from 120 to 400° C., for example kerosine, jet fuel, diesel and heating oil. The novel fuels preferably contain less than 350 ppm and especially less than 200 ppm of sulfur. Their GC-determined content of n-paraffins having a chain length of 18 carbon atoms or more is at least 8 area %, preferably more than 10 area %. Compared with the closest prior art, in particular EP-A-0 796 306, the advantage of the novel process is improved solubility of the additives, which means that the filterability of the oils containing the additives is retained even after additive addition at low temperatures of oil and/or additive. In addition, the novel mixtures exhibit pronounced synergistic effects in CFPP lowering compared with the individual components.

The additive mixtures can be used alone or together with other additives, for example dewaxing auxiliaries, corrosion inhibitors, antioxidants, lubricity additives, dehazers, conductivity improvers, cetane number improvers or sludge inhibitors.

EXAMPLES

TABLE 1

Characterization of the additives
The following copolymers and terpolymers of ethylene are employed, in each case as a 50% suspension in kerosine:

| | Vinyl acetate | $CH_3$/100$CH_2$ | Termonomer | $V_{140}$ |
|---|---|---|---|---|
| A1) | 24.9% (10.0 mol %) | 5.4 | 1.5 mol % 4-MP | 375 mPas |
| A2) | 22.5% (9.1 mol %) | 6.5 | 2.6 mol % 4-MP | 287 mPas |
| A3) | 26.2% (10.8 mol %) | 6.0 | 2.11 mol % 4-MP | 486 mPas |
| A4) | 22.0% (9.0 mol %) | 8.0 | 3.8 mol % 4-MP | 335 mPas |
| B1) | 32.0% (13.3 mol %) | 3.2 | — | 125 mPas |
| B2) | 32.0% (14.0 mol %) | 6,5 | 1.6 mol % VeoVa | 110 mPas |
| B3) | 31.7% (14.9 mol %) | 7.2 | 2.2 mol % VeoVa | 240 mPas |

$V_{140}$ = melt viscosity at 140° C., measured in accordance with EN 3219
VeoVa = vinyl neodecanoate
4-MP = 4-methyl-1-pentene

TABLE 2

Characterization of the test oils
The boiling data are determined as described in ASTM D-86, the CFPP value in accordance with EN 116 and the cloud point in accordance with ISO 3015. The paraffin content is determined by gas-chromatographic separation of the oil (detection by FiD) and calculation of the integral of the $C_{18}$-n-paraffins compared with the total integral.

| | Test oil 1 (° C.) | Test oil 2 (° C.) | Test oil 3 (° C.) | Test oil 4 (° C.) | Test oil 5 (° C.) | Test oil 6 (° C.) |
|---|---|---|---|---|---|---|
| Start of boiling | 180 | 169 | 183 | 183 | 184 | 182 |
| 20% | 267 | 255 | 226 | 232 | 258 | 243 |
| 90% | 350 | 350 | 330 | 358 | 329 | 351 |
| 95% | 365 | 364 | 347 | 378 | 344 | 366 |
| Cloud point | −0.4 | −1 | −9 | +4 | −5 | −3 |
| CFPP | −3 | −3 | −12 | −4 | −9 | −6 |
| (90–20)% | 83 | 95 | 104 | 126 | 71 | 108 |
| n-paraffins ≧$C_{18}$[area %] | 11.8 | 10.9 | 9.6 | 10.5 | 8.5 | 11.3 |
| S content [ppm] | 270 | 540 | 175 | 375 | 295 | 430 |

Determination of the CFPP Stability

The CFPP value of the oil to which the stated amount of flow improvers have been added was measured directly after their addition and the remainder of the sample was stored at −3° C., i.e below the cloud point. At weekly intervals, the samples were warmed to 12° C., 50 ml were removed for a further CFPP measurement and the remainder was again stored at −3° C.

TABLE 3

CFPP stability in test oil 1
800 ppm of additive, 50% in kerosine, were added to test oil 1

| | CFPP | | | | |
|---|---|---|---|---|---|
| | (immediately) | 1 week | 2 weeks | 3 weeks | 4 weeks |
| A1 + B1 (1:5) | −14 | −13 | −11 | −12 | −11 |
| A1 + B2 (1:3) | −12 | −14 | −12 | −11 | −12 |
| A2 + B3 (1:4) | −14 | −12 | −11 | −13 | −11 |
| A3 + B2 (1:2) | −12 | −12 | −11 | −9 | −11 |
| A4 + B3 (1:4) | −13 | −12 | −13 | −11 | −11 |
| A1 + B2 (1:2) | −14 | −14 | −10 | −13 | −14 |
| A1 + B1 + B2 (1:2:2) | −14 | −12 | −12 | −15 | −12 |
| B1 (comparison) | −10 | −4 | −5 | −3 | −4 |
| B2 (comparison) | −11 | −7 | −5 | −4 | −5 |
| B3 (comparison) | −10 | −9 | −7 | −7 | −5 |

TABLE 4

CFPP stability in test oil 2
800 ppm of additive, 50% in kerosine, were added to test oil 2

| | CFPP | | | | |
|---|---|---|---|---|---|
| | (immediately) | 1 week | 2 weeks | 3 weeks | 4 weeks |
| A1 + B2 (1:3) | −12 | −10 | −10 | −12 | −10 |
| A2 + B3 (1:4) | −11 | −12 | −11 | −12 | −12 |
| B2 (comparison) | −10 | −9 | −7 | −8 | −5 |
| B3 (comparison) | −10 | −9 | −6 | −6 | −5 |

CFPP Stability in Test Oil 6

TABLE 5a

CFPP values immediately after addition of the additive

| | CFPP (° C.) | | |
|---|---|---|---|
| Additive | 50 ppm | 100 ppm | 150 ppm |
| B1 | −10 | −15 | −16 |
| B2 | −14 | −15 | −15 |
| A4 + B1 (1:3) | −11 | −16 | −17 |
| A4 + B2 (1:5) | −10 | −14 | −15 |

TABLE 5b

CFPP values after storage for 4 days at 2° C.

| | CFPP (° C.) | | |
|---|---|---|---|
| Additive | 50 ppm | 100 ppm | 150 ppm |
| B1 | −9 | −10 | −9 |
| B2 | −8 | −10 | −9 |
| A4 + B1 (1:3) | −11 | −15 | −17 |
| A4 + B2 (1:5) | −11 | −15 | −16 |

TABLE 6

CFPP synergism in test oil 3

| | 50 ppm | 100 ppm | 200 ppm |
|---|---|---|---|
| A1 + B1 (1:2) | −20 | −22 | −24 |
| A1 + B2 (1:3) | −19 | −21 | −26 |
| A1 (comparison) | −16 | −18 | −18 |
| B1 (comparison) | −17 | −20 | −23 |
| B2 (comparison) | −11 | −15 | −22 |

TABLE 7

CFPP synergism in test oil 4

| | 100 ppm | 200 ppm | 300 ppm |
|---|---|---|---|
| A1 + B2 (1:1) | −12 | −15 | −16 |
| A1 + B1 (1:2) | −11 | −13 | −17 |
| A1 (comparison) | −6 | −8 | −10 |
| B1 (comparison) | 1 | −8 | −12 |
| B2 (comparison) | −3 | −2 | −5 |

Solubility of the Mixtures

The solubility behavior of the terpolymers is determined in the British Rail test as follows: 400 ppm of a polymer dispersion in kerosine, held at a temperature of 22° C., are added to 200 ml of test oil 5, held at 22° C., and the mixture is shaken vigorously for 30 seconds. After storage at +3° C. for 24 hours, the mixture is shaken for 15 seconds and subsequently filtered at 3° C. in three portions of 50 ml each through a 1.6 $\mu$m glass-fiber microfilter (Ø 25 mm; Whatman GFA, Order No. 1820025). The three filtration times $T_1$, $T_2$ and $T_3$, whose sum must not exceed 20 minutes, are used to calculate the ADT value as follows:

$$DT = \frac{(T3 - T1)}{T2} \cdot 50$$

An ADT value of ≦15 is regarded as an indication that the gas oil can be used satisfactorily in "normal" cold weather. Products having ADT values of >25 are regarded as unfilterable.

TABLE 8

Solubility of the additives

| | ADT |
|---|---|
| Blank value (without additive) | 3.0 |
| A1 + B2 (1:5) | 5.8 |
| A1 + B3 (1:3) | 6.0 |
| A3 + B1 (1:1) | 12.5 |
| A4 + B2 (1:4) | 8.2 |
| B2 (comparison) | 5.4 |
| B2 + 4% of EVA copolymer containing 13.5% by weight of vinyl acetate (as in WO 97/17905) | 60 |
| B2 + 10% of EVA copolymer containing 13.5% by weight of vinyl acetate (as in WO 97/17905) | unfilterable (115 ml in 20 minutes) |

List of Trade Names Used

| | |
|---|---|
| Solvent Naphtha ® Shellsol AB | aromatic solvent mixtures having a boiling range of from 180 to 210° C. |

-continued

| | |
|---|---|
| ® Solvesso 150 | |
| ® Solvesso 200 | aromatic solvent mixture having a boiling range of from 230 to 287° C. |
| ® Exxsol | dearomatized solvent in various boiling ranges, for example ® Exxsol D60: 187 to 215° C. |
| ® ISOPAR (Exxon) | isoparaffinic solvent mixtures in various boiling ranges, for example ® ISOPAR L: 190 to 210° C. |
| ® Shellsol D | mainly aliphatic solvent mixtures in various boiling ranges. |

What is claimed is:

1. A process for improving the cold-flow properties of oils having a sulfur content of less than 500 ppm and a content of n-paraffins having a chain length of $C_{18}$ or longer of at least 8% by weight, comprising adding to the oils an additive comprising a mixture of A) from 15 to 50% by weight of a copolymer comprising, besides from 87 to 92 mol % of structural units derived from ethylene;

a) from 6.5 to 12 mol % of structural units derived from vinyl acetate and b) from 0.5 to 6 mol % of structural units derived from 4-methyl-1-pentene, with the proviso that the sum of the molar proportions of structural units a) and b) is from 8 to 14 mol %, and B) from 85 to 50% by weight of at least one further copolymer or terpolymer of ethylene and vinyl esters or acrylates which is a cold-flow improver.

2. The process as claimed in claim 1, wherein copolymer A) contains from 7 to 11 mol % of the structural units indicated under a).

3. The process as claimed in claim 1, wherein copolymer A) contains from 1 to 4 mol % of the structural units indicated under b).

4. The process as claimed in claim 1, wherein the additive mixture has a melt viscosity at 140° C. of from 20 to 10,000 mPas.

5. The process as claimed in claim 1, wherein the copolymers mentioned under A) or B) contain up to 5% by weight of further comonomers.

6. The process as claimed in claim 5, wherein the further comonomers are vinyl esters, vinyl ethers, alkyl acrylates, alkyl methacrylates, isobutylene or higher olefins having at least 5 carbon atoms.

7. The process as claimed in claim 1, wherein paraffin dispersants and/or comb polymers are used as further components of the additive composition.

8. The process as claimed in claim 1, wherein the additive mixtures comprise from 20 to 40% by weight of component A) and from 60 to 80% by weight of component B).

9. The process as claimed in claim 4, wherein the additive mixture has a melt viscosity at 140° C. of from 30 to 5000 mPas.

10. The process as claimed in claim 6, wherein the higher olefins having at least 5 carbon atoms are selected from hexene, octene or diisobutylene.

* * * * *